US006016604A

United States Patent [19]

Wolf et al.

[11] Patent Number: 6,016,604

[45] **Date of Patent: *Jan. 25, 2000**

[54] PORTABLE, HAND-GUIDED WORKING TOOL WITH A REAR GRIP

[75] Inventors: Günter Wolf, Oppenweiler; Manfred Thaiss, Winnenden, both of Germany

[73] Assignee: Andreas Stihl AG & Co., Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/900,100

[22] Filed: Jul. 25, 1997

[30] Foreign Application Priority Data

Aug. 1, 1996 [DE] Germany ..... 196 31 033

[51] Int. Cl.[7] ..... B23D 57/02

[52] U.S. Cl. ..... 30/383; 30/382; 30/386

[58] Field of Search ..... 30/383, 382, 386, 30/381

[56] References Cited

U.S. PATENT DOCUMENTS

| | | | |
|---|---|---|---|
| 3,530,909 | 9/1970 | Scharpf | 30/381 |
| 3,542,095 | 11/1970 | Frederickson et al. | 30/381 |
| 3,637,029 | 1/1972 | Sherwood, Jr. et al. | 30/383 |
| 3,652,074 | 3/1972 | Frederickson et al. | 30/381 |
| 3,680,608 | 8/1972 | Emmerich et al. | 30/383 |
| 3,698,455 | 10/1972 | Frederickson et al. | 30/381 |
| 3,728,793 | 4/1973 | Makinson et al. | 30/383 |
| 3,813,776 | 6/1974 | Frederickson et al. | 30/381 |
| 3,845,557 | 11/1974 | Bailey | 30/381 |
| 3,889,763 | 6/1975 | Dillon | 30/381 |
| 3,911,580 | 10/1975 | Bailey | 30/381 |
| 3,945,119 | 3/1976 | Nagashima et al. | 30/383 |
| 3,972,119 | 8/1976 | Bailey | 30/381 |
| 4,010,544 | 3/1977 | Siman | 30/381 |
| 4,041,606 | 8/1977 | Thompson | 30/381 |
| 4,138,812 | 2/1979 | Zimmerer et al. | 30/381 |
| 4,141,143 | 2/1979 | Hirschkoff et al. | 30/381 |
| 4,198,752 | 4/1980 | Bross | 30/381 |
| 4,261,105 | 4/1981 | Love | 30/383 |
| 4,670,985 | 6/1987 | Biersteker | 30/381 |
| 4,964,217 | 10/1990 | Siede et al. | 30/383 |
| 5,016,355 | 5/1991 | Gassen et al. | 30/383 |
| 5,038,480 | 8/1991 | Naslund | 30/383 |
| 5,212,886 | 5/1993 | Tasaki | 30/382 |
| 5,361,500 | 11/1994 | Naslund et al. | 30/381 |
| 5,447,295 | 9/1995 | Taomo | 30/381 |

FOREIGN PATENT DOCUMENTS

| | | |
|---|---|---|
| 2003918 | 8/1971 | Germany . |
| 4407432 | 9/1995 | Germany . |
| 1224822 | 3/1969 | United Kingdom . |

*Primary Examiner*—M. Rachuba
*Assistant Examiner*—Sean Pryor
*Attorney, Agent, or Firm*—Robert W. Becker & Associates

[57] ABSTRACT

A portable, hand-guided working tool has a drive motor and a motor housing in which the drive motor is housed. The motor housing has a front side and a rear side when viewed in the direction of the longitudinal center axis of the working tool. A tool member is connected to the front side of the motor housing and extends forwardly in the direction of the longitudinal center axis. The tool member is driven by the drive motor. The rear grip is connected by vibration damping elements to the rear side of the motor housing and extends rearwardly in the direction of the longitudinal center axis. An abutment device includes a first abutment member connected to the motor housing and positioned between the rear end and the rear grip and includes a second abutment member connected to the rear grip and cooperating with the first abutment member for limiting a relative movement between the motor housing and the rear grip.

10 Claims, 9 Drawing Sheets

PORTABLE, HAND-GUIDED WORKING TOOL WITH A REAR GRIP

BACKGROUND OF THE INVENTION

The present invention relates to a portable, hand-guided working tool, especially a motor chain saw, comprising a drive motor which is arranged in a motor housing and which drives a working tool. The working tool is positioned at the front side of the motor housing and extends in the direction of the longitudinal center axis of the motor housing. A rear grip is positioned at the rear side of the motor housing and is connected thereto by vibration damping elements. It extends substantially to the rear in the direction of the longitudinal center axis.

In a working tool of the aforementioned kind, for example, a motor chainsaw according to German Patent Application 44 07 432, the rear grip is connected by vibration damping elements at the motor housing in order to provide for a vibration decoupling of the grip from the motor housing. When such dampening devices are soft, an excellent damping can be obtained. However, guiding of the motor chainsaw is also soft. In order to achieve a good guiding behavior, it is thus necessary to use relatively hard damping elements which, in turn, produce only a minimal damping action.

It is therefore an object of the present invention to improve a motor chainsaw of the aforementioned kind such that, while providing a good damping action at least under load conditions, a good guiding behavior can be achieved.

SUMMARY OF THE INVENTION

The portable, hand-guided working tool according to the present invention is primarily characterized by:

a drive motor;

a motor housing in which the drive motor is housed;

the motor housing having a front side and a rear side when viewed in the direction of a longitudinal center axis of the working tool;

a tool member connected to the front side of the motor housing and extending forwardly in the direction of the longitudinal center axis;

the tool member driven by the drive motor;

a rear grip connected by vibration damping elements to the rear side of the motor housing and extending rearwardly in the direction of the longitudinal center axis;

an abutment device comprising a first abutment member connected to the motor housing and positioned between the rear end and the rear grip and comprising a second abutment member connected to the rear grip and cooperating with the first abutment member for limiting a relative movement between the motor housing and the rear grip.

Preferably, the rear grip comprises at least one securing flange. The first abutment member extends perpendicularly to the rear side and adjacent to the at least one securing flange. The second abutment member is connected to the at least one securing flange.

The motor housing comprises a basic casing and a cover, wherein the first abutment member engages the housing at a separating line between the basic casing and the cover and is secured at the housing by a screw.

The first and second abutment members, in a rest position of the housing and the rear grip, are spaced from one another.

The abutment device comprises an elastic element positioned between the first and second abutment members.

The elastic element encloses one of the first and second abutment members.

The first and second abutment members intermesh with one another.

Advantageously, one of the first and second abutment members is a rigid abutment flange having a bore and the other of the first and second abutment members is a bolt engaging the bore.

The abutment flange is positioned in a plane extending parallel to a plane of the rear grip.

The abutment device further comprises a fastening flange having a connecting portion, wherein the connecting portion is connected to the abutment flange. The fastening flange, the connecting portion, and the abutment flange together form a Z-shaped base body. The fastening flange and the abutment flange extend parallel and spaced at a distance to one another.

The abutment flange is closer to the longitudinal center axis then the fastening flange.

The basic casing comprises a fastening projection and the fastening flange engages behind the fastening projection.

The abutment device and the vibration damping elements are positioned within the same half of the motor housing as divided along the longitudinal center axis.

The vibration damping elements and the abutment device are positioned in a plane parallel to a sidewall of the motor housing.

The abutment device is positioned on the longitudinal center axis.

With the inventively arranged stroke-limiting abutment device the use of soft vibration damping elements is possible which, for minimal guiding forces, provide a good guiding behavior of the motor chainsaw and ensure a high damping action. When greater guiding forces must be transmitted, the relative movement of the rear grip relative to the motor housing can be limited by the abutment device so that a strong coupling of the rear grip with the motor housing is provided. Since relative to the entire period of operation the periods requiring a greater guiding force are minimal, the reduced damping, resulting for greater coupling via the abutment device, does not result in a substantial impediment of the damping action.

Preferably, the part (abutment member) of the abutment device that is fixedly connected to the housing extends perpendicularly to the rear side of the motor housing and extends adjacent to at least one securing flange of the rear grip that supports the second part (abutment member) of the abutment device. The abutment members, in a rest position, are positioned at a distance to one another so that during normal operation of the motor chainsaw with minimal guiding forces only the softer vibration damping elements connect the rear grip to the motor housing so that a great vibration damping action is provided.

In order to ensure a sufficient vibration damping action even when greater guiding forces are transmitted, an elastic element made of an elastic material is provided between the abutment device acting on one another.

Preferably, at least one abutment member of the abutment device is substantially completely enclosed by an elastic material and the abutment members of the abutment device intermesh with one another. In a further embodiment, one abutment member is a rigid abutment flange with a bore and the other abutment member is an abutment bolt engaging the bore.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
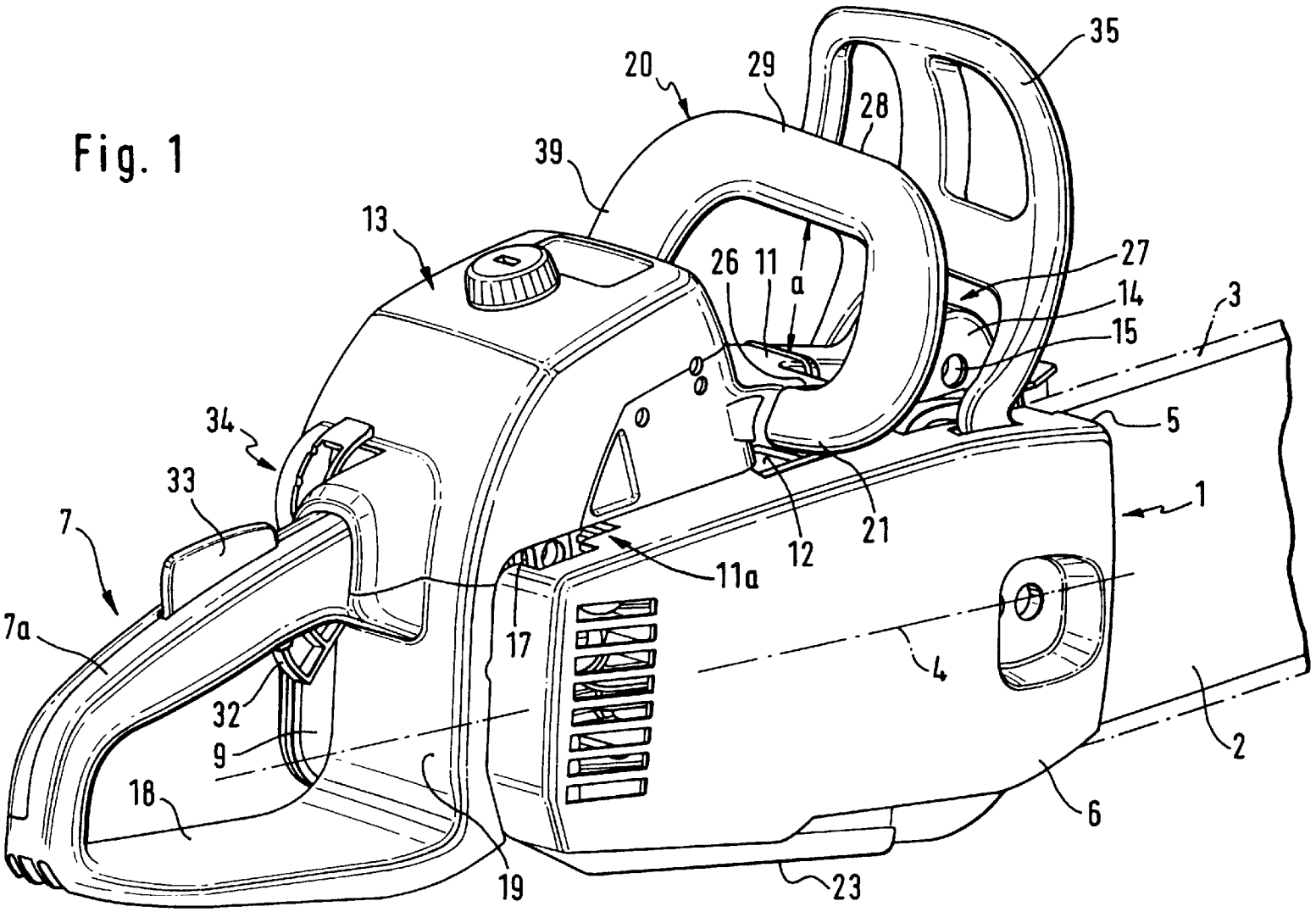
FIG. 1 is a perspective representation of the inventive motor chainsaw.

The present invention will now be explained in detail with the aid of several specific embodiments.

The portable, hand-guided working tool represented in FIGS. 1 through 4 is a motor chainsaw which comprises a drive motor arranged in the motor housing 1, whereby the drive motor is especially an internal combustion engine such as a two-stroke engine. The drive motor drives a tool member which in the embodiment shown is a saw chain 3 guided about a guide rail 2. The motor housing 1 is comprised of a basic casing 10 with an top side 12, a housing bottom 23 as well as a front side 5 and a rear side 9. A chain wheel cover 6 is connected to a sidewall of the basic housing 10, and at the opposite sidewall a vent cover 8 is provided. The working tool is positioned in front of the front side of the motor housing 1. In the shown embodiment, the guide rail 2 extends substantially in the direction of the longitudinal center axis 4 of the motor housing 1 perpendicularly to the front side 5 in the forward direction. The guide rail 2 is clamped and secured between the basic casing 10 and the chain wheel cover 6 that is secured laterally to the basic casing 10.

A rear grip 7 as well as a grip bracket 20 are connected to the motor housing 1. The rear grip 7 extends substantially in the direction of the longitudinal axis 4 of the motor housing 1 to the rear and is connected to the rear side 9, which is positioned at the working tool opposite to the guide rail 2 for guiding the saw chain 3. The rear grip 7 positioned behind the motor housing 1 comprises a support arm 11 which in the longitudinal direction of the motor housing 1 extends across its top side 12 from the rear side 9 to the front side 5. The support arm 11 has a width corresponding to the width of the actuating section 7*a* of the rear grip 7 (FIG. 3) and is positioned together with the rear grip 7 along the longitudinal center axis 4. Preferably, the support arm 11 and the rear grip 7 are a unitary component (FIG. 5) comprised of plastic material and manufactured as an injection-molded part. As shown in FIGS. 1 through 6, the support arm 11 within the connecting area 11*a* into the rear grip 7 is in the form of a carburetor housing 13 which is open at a side thereof facing away from the top side 12. The carburetor housing 13 is positioned away from the longitudinal center axis 4 from the support arm 11 and of the rear grip 7 (FIG. 3).

Figure 2:
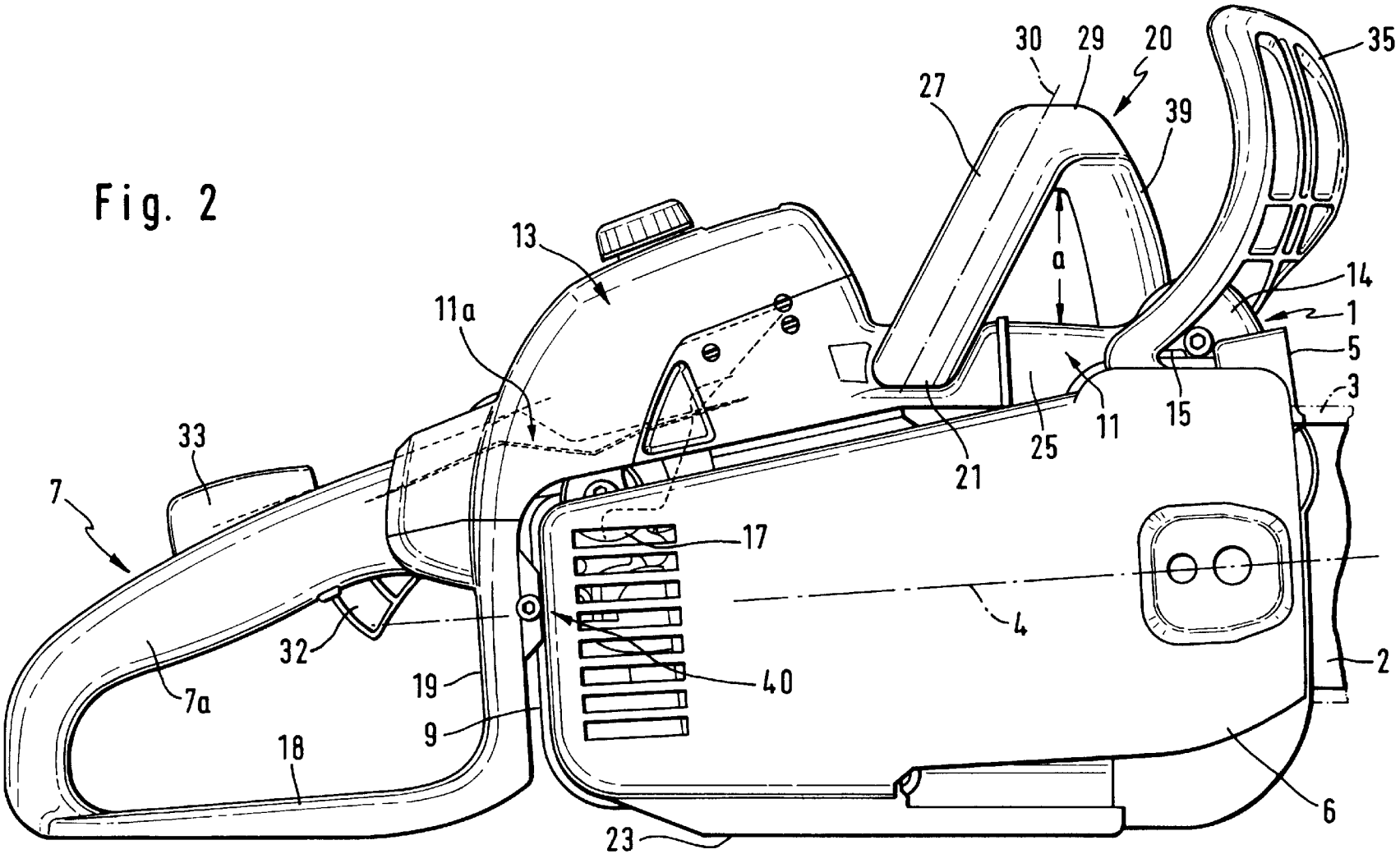
FIG. 2 is a side view of the motor chainsaw according to FIG. 1.
Figure 3:
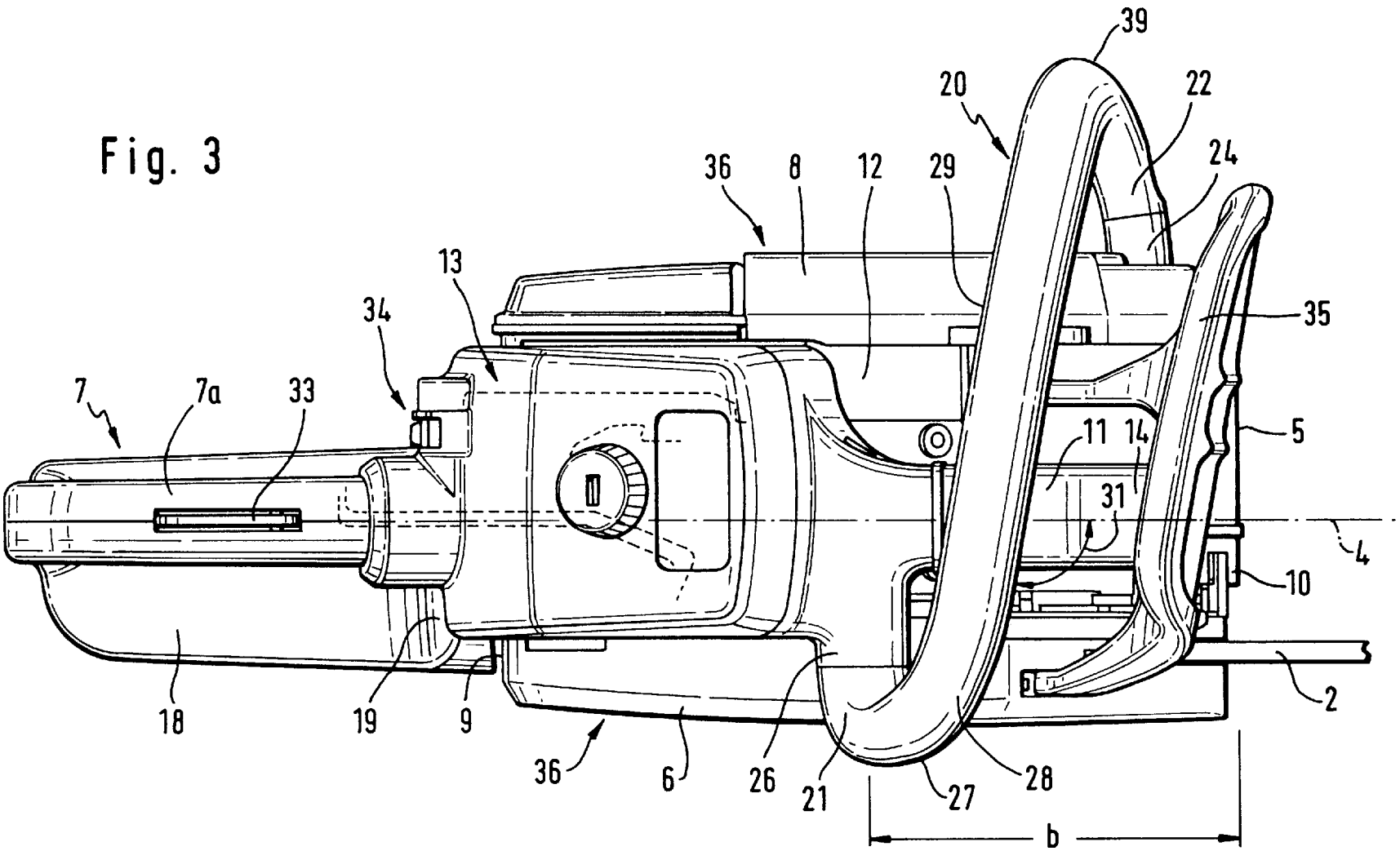
FIG. 3 is a plan view onto the motor chainsaw according to FIG. 1.
Figure 4:
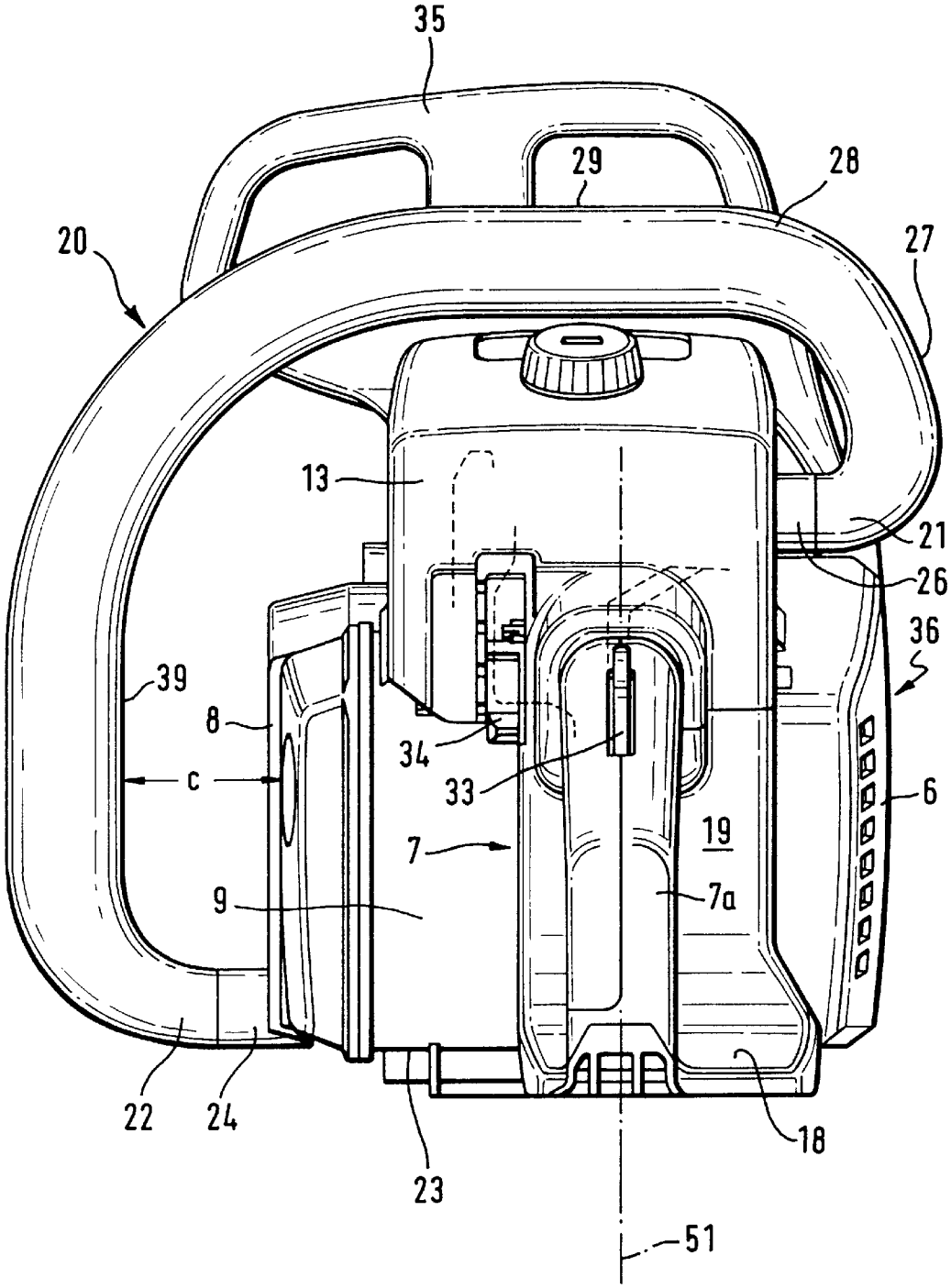
FIG. 4 is a rear view of the motor chainsaw according to FIG. 1.
Figure 6:
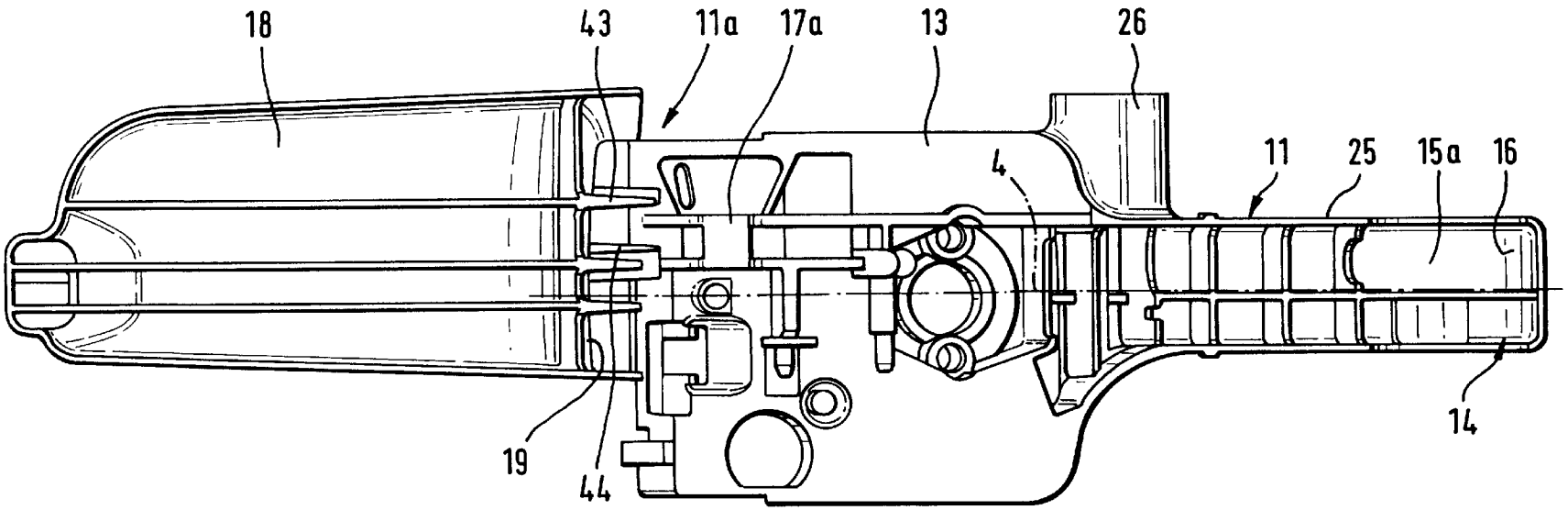
FIG. 6 is a view of the rear grip according to FIG. 5 from below.
Figure 7:
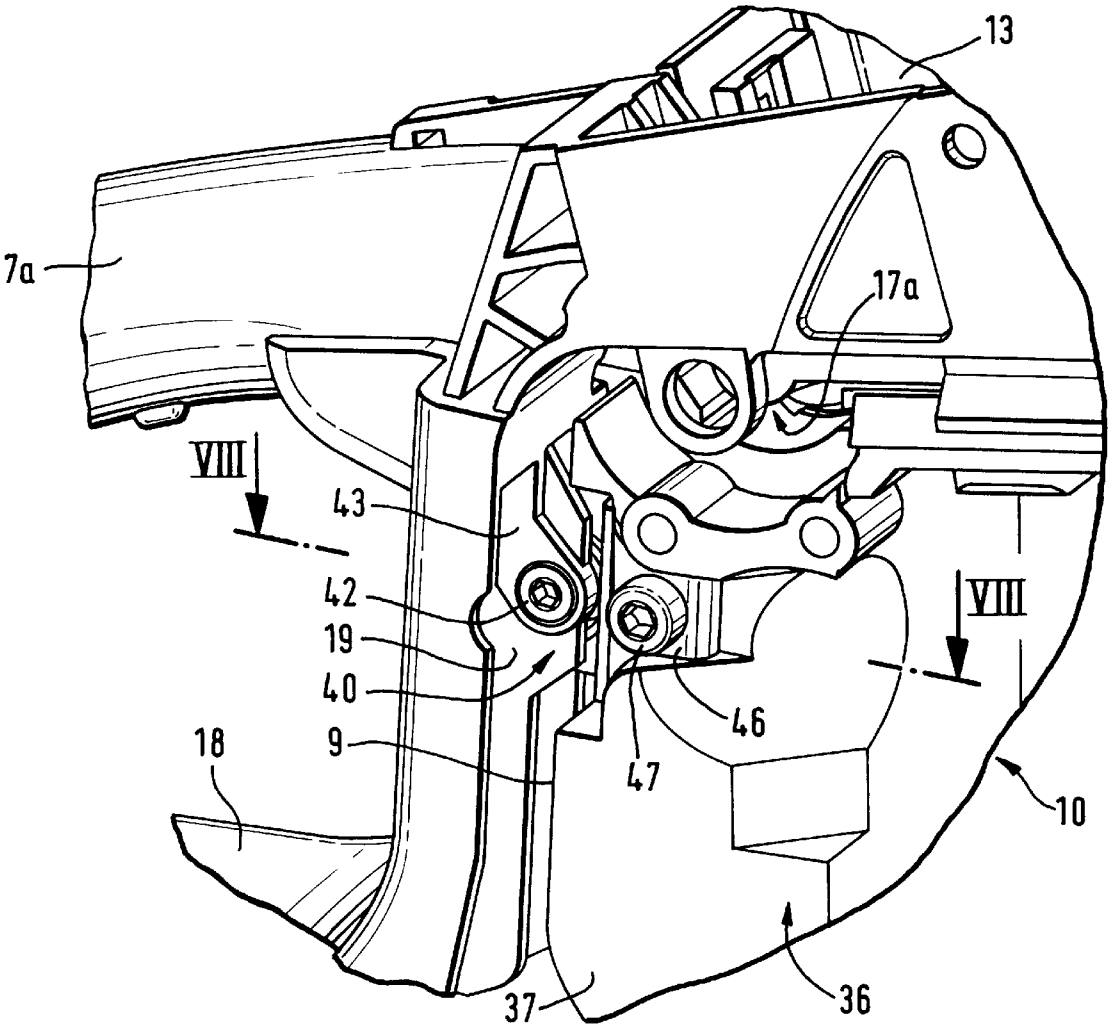
FIG. 7 is an enlarged representation of the abutment device positioned between the motor housing and the rear grip.

The forward end 14 of the claw-shaped support arm 11 engages like a hood a vibration damping element 15 at the top side 12 of the motor housing 1 which, as shown in FIG. 2, neighbors the front side 5. As can be seen in FIG. 6, the forward end 14 of the claw-shaped support arm 11 has a receiving member 15*a* for the vibration damping element 15. The receiving member 15*a* is positioned within one half 16 of the motor housing 1 as divided along relative to the longitudinal center axis 4.

In the vicinity of the rear side 9 of the motor housing 1 a further vibration damping element 17 is aligned with the vibration damping element 15 on the top side 12 in the longitudinal direction of the motor chainsaw. This second vibration element 17 is engaged by the connecting area 11*a* of the support arm 11. The connecting area 11*a* is adjacent to the actuating section 7*a* of the rear grip 7. The actuating section 7*a* together with the bottom plate 18 and an end plate 19, extending substantially parallel to the rear side 9 of the motor housing 1, forms a frame-like closed rear grip 7. The rear grip 7 defines a plane 51 which extends approximately parallel to a sidewall 36 of the motor housing 1. As can be seen especially in FIG. 6, within the half 16 of the motor housing 1 as divided along the longitudinal center axis 4 a receiving member 17*a* for the vibration damping element 17 is provided at the underside of the connecting area 11*a*. The element 17 is secured at the support arm 11. The component (see FIG. 5) comprised of the rear grip 7 and the support arm 11 formed as a unitary part thereof is thus connected to the motor housing 1 by the vibration damping elements 15 and 17 provided at the top side 12 of the motor housing 1.

A throttle lever 32 is arranged within the rear grip 7 in the actuating section 7*a* at the side facing the bottom plate 18. A throttle lever lock 33 is arranged at the opposing side of the actuating section 7*a*. Via the throttle lever 32 a carburetor arranged in the carburetor housing 13 is controlled as can be seen in a dashed line in FIG. 3. The wall of the carburetor housing 13 facing the actuating section 7*a* comprises further operating elements 34 for the motor chainsaw.

FIGS. 1 through 4 further show a grip bracket 20 secured with its first end 21 in the forward area of the support arm 11 and with its second end 22 in the vicinity of the housing bottom 23, adjacent to the front side 5, laterally at the motor housing 1. The second end 22 is fastened to the motor housing 1 by a vibration damping element 24 while the first end 21 is rigidly mounted to the support arm 11. For this purpose, the longitudinal side 25 of the support arm 11 facing away from the second end 22 is provided with a connecting member 26, that, as can be seen in FIGS. 3 and 6, extends approximately at a right angle to the longitudinal center axis 4 of the support arm 11 perpendicularly to the longitudinal side 25. The connecting member 26 borders directly the carburetor housing 13. It is positioned at the side of the carburetor housing 13 facing the end 14 of the support arm 11.

Figure 5:
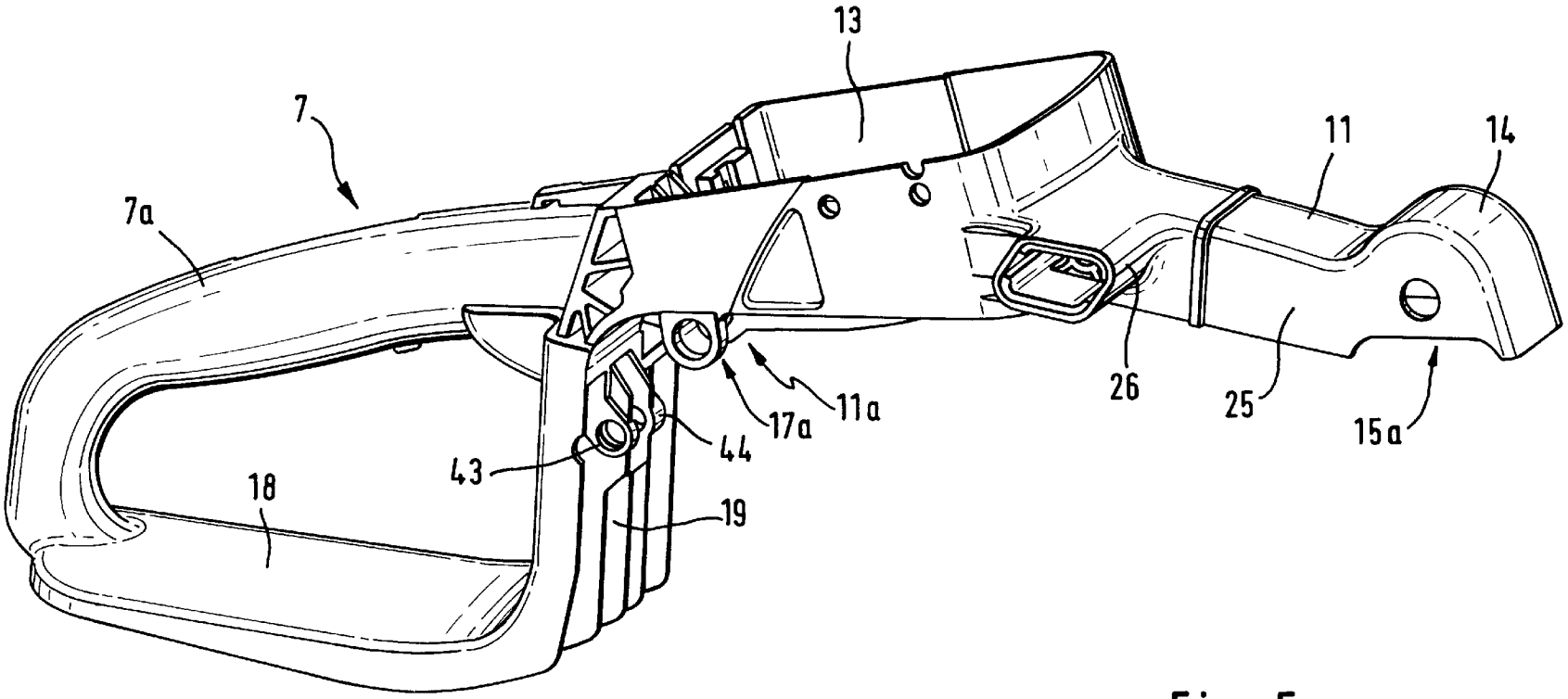
FIG. 5 is a perspective representation of a rear grip with a support arm.

The connecting member 26, as can be seen in FIG. 5, has a rectangular, rounded cross-section that matches the end 21 of the grip bracket 20. The cross-section can also be described as being similar to a parallelogram. The end 21 of the grip bracket 20 is inserted into the connecting member 26 whereby its cross-sectional shape that deviates from a circular shape ensures a rotationally fixed connection.

The first end 21 of the grip bracket 20 is formed by one leg of a U-shaped end section 27 of the grip bracket 20. The second leg 28 has a transition into a horizontal grip bracket section 29. The horizontally extending grip bracket section 29 extends across the support arm 11 and is spaced at a perpendicular distance a to the top side 12. The distance a is measured such that a user's hand has sufficient space for gripping the horizontal grip bracket section 29.

The plane 30 (FIG. 2) defined by the U-shaped end section 27 is positioned at a slant relative to the front side 5. The horizontally extending grip bracket section 29, in a plan view onto the motor chainsaw, is positioned at an angle 31 relative to the longitudinal center axis 4 that differs from 90°. Preferably, the horizontally extending grip bracket section 29 extends at a slant forwardly from the leg 28, respectively, the connecting member 26 into the substantially vertical grip bracket section 39 which is positioned at a lateral distance c to the vent cover 8. It is laterally secured at the motor housing 1 by the end 22 in the area of the housing bottom 23 and in the vicinity of the front side 5. The second end 22 of the grip bracket 20 is thus positioned in the vicinity of the front side 5 of the motor housing 1 in the area of the housing bottom 23, while the first end 21 is positioned at the connecting member 26 in the vicinity of the top side 12 at a greater distance b to the front side 5.

The motor housing 1 with the drive motor, the guide rail 2, and the saw chain 3 guided thereat is gripped by a user at the rear grip 7 and the grip bracket 20 for holding and guiding. The grip bracket 20 has positioned thereat a hand protector 35 via which a non-represented chain brake is activated when, for example, the user's hand slips off the grip bracket 20. The chain brake is integrated in a manner known per se into the chain wheel cover.

As can be seen in FIG. 6, the receiving members 15*a*, 17*a* for the vibration damping elements 15 and 17 at the top side 12 are arranged together within one half 16 of the housing 1 as divided along the longitudinal center axis 4 facing away from the end 22 of the grip bracket 20. In addition to these vibration damping elements 15 and 17 at the top side 12, for producing an even more improved guiding under load an abutment device 40 is provided preferably within the same half 16. The abutment device 40 is provided between the rear grip 7, i.e., its end plate 19, and the rear side 9 of the motor housing 1. Preferably, the abutment device 40 is positioned at the level or slightly above the longitudinal center axis 4 of the motor housing 1. Such an abutment device 40 limits the possible relative movement between the motor housing 1 and the rear grip 7 so that for soft vibration damping elements 15 and 17 under load a precise and a stiff guiding of the motor chainsaw is possible.

The abutment device 40 is suitable for any hand-guided, portable working tool with a rear grip 7 and is comprised of a first component (abutment member) that is fixedly connected to the housing, for example, an abutment flange 41, and a second component (abutment member) cooperating therewith and connected at the rear grip 7, for example, is in the form of an abutment bolt 42.

From FIGS. 7 through 10 it can be taken that the abutment flange 41 extends perpendicularly to the rear side 9 and especially parallel to the sidewalls 36 of the motor housing 1. It is positioned adjacent to at least one securing flange 43 which is provided at a side of the end plate 19 of the rear grip 7 facing the motor housing 1. In the shown embodiment, the abutment flange 41 secured at the housing so as to be positioned between two securing flanges 43 and 44 of the end plate 19. The abutment flange 41 comprises an abutment opening (bore) 45 which is penetrated by the abutment bolt 42. The bolt 42 is fastened to the securing flanges 43 and 44. The vibration damping elements 15, 17 at the top side 12 and the abutment element 40 are positioned in a common plane which extends preferably parallel to the sidewalls 36 of the motor housing 1, respectively, parallel to a plane 51 defined by the rear grip 7.

The abutment flange 41 formes one leg of the Z-shaped body 50. The other leg forms a fastening flange 46 which is positioned at a lateral distance Z to the plane parallel to the abutment flange 41. The fastening flange 46 is connected with a fastening screw 47 to the basic casing 10 of the motor housing 1. The fastening flange 46 is positioned in the separating plane 37 between the chain wheel cover 6 and the basic casing 10. The fastening flange 46 engages a fastening projection 48 provided at the basic casing 10 which extend approximately perpendicularly to the separating plane 37.

Figure 8:
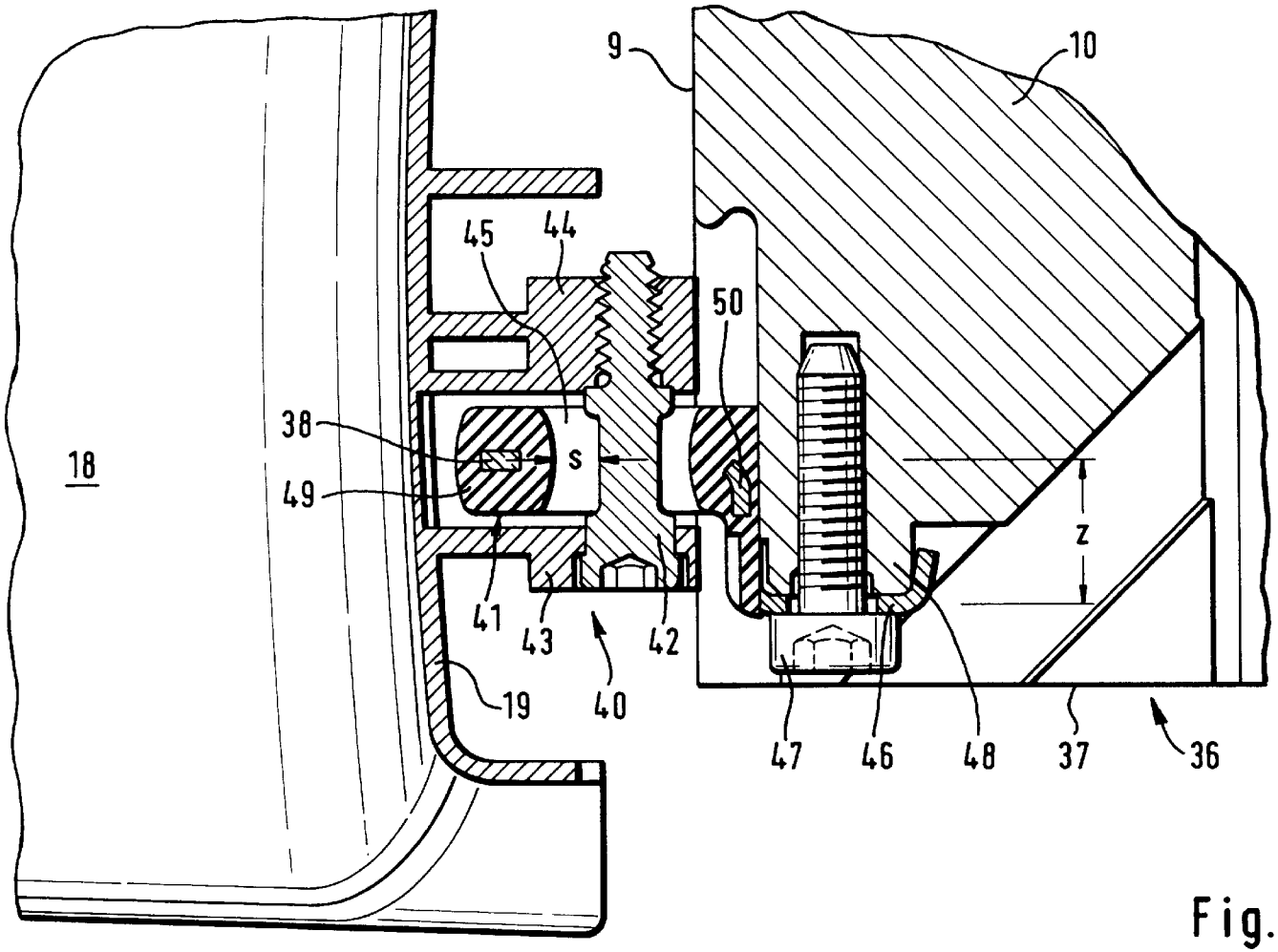
FIG. 8 is a section along the line VIII—VIII of FIG. 7.

As shown in FIG. 8, the abutment flange 41, compared relative to the fastening flange 46, is positioned closer to the motor housing center by a distance Z.

The position of the abutment device 40 is such that it is positioned at the level of the longitudinal center axis 4 of the motor housing 1 and preferably within a half 16 relative to the longitudinal center axis 4 in which also the other vibration damping elements 15 and 17 for securing the rear grip 7 are provided.

Figure 9:
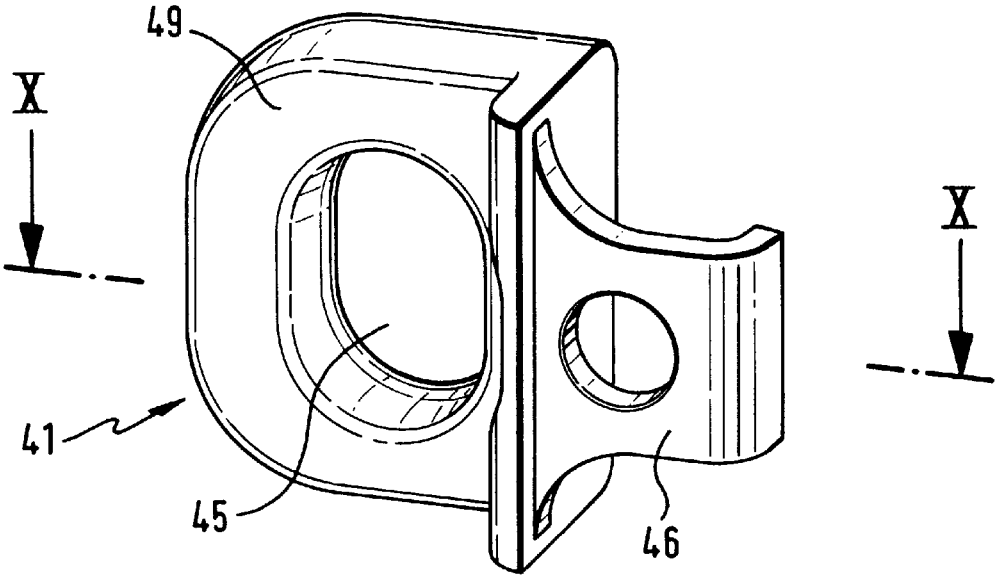
FIG. 9 is a perspective view of the abutment flange and a securing flange.
Figure 10:
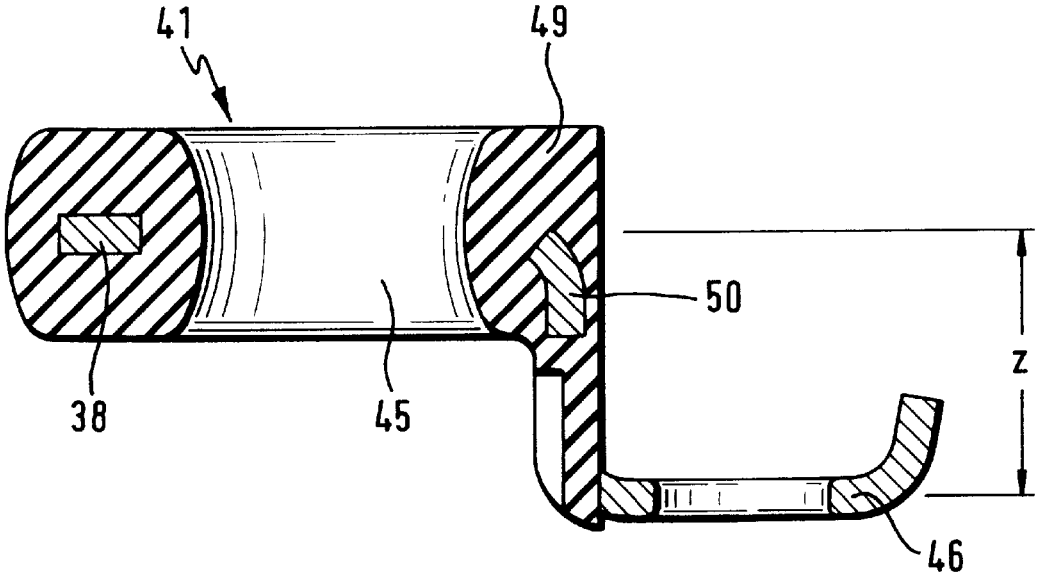
FIG. 10 shows a section along the line X—X of FIG. 9.

In the rest position of the abutment device 40 represented in FIG. 8, the abutment bolt 42 is positioned with play s preferably centrally within the bore 45 (FIG. 8 through 10). Between the abutment bolt 42 and the frame 38 of the rigid base body 50 of the abutment flange 41 an elastic element of elastic material 49 is arranged which encloses the rigid frame 38 completely. The frame 38 of the abutment flange 41 is completely embedded in the elastic material so that a metallic and thus vibration-transmitting contact between the abutment bolt 42 and the abutment flange 41 can be avoided. It may be expedient to embed the abutment bolt instead of the abutment flange in the elastic material.

The elastic element 49 of the abutment flange 41 may have a greater hardness than the vibration damping elements 15 and 17 that support the rear grip 7. The damping action is thus determined first by the vibration damping elements 15 and 17. When the bolt 42 abuts the elastic material 49 of the abutment flange 41, a harder damping action is provided which progressively increases upon increasing forces pressing onto the elastic material 49. Even greater guiding forces can thus be safely transmitted onto the working tool.

The present invention is, of course, in no way restricted to the specific disclosure of the specification and drawings, but also encompasses any modifications within the scope of the appended claims.

What we claim is:

1. A portable, hand-guided working tool comprising:

a drive motor;

a motor housing in which said drive motor is housed;

said motor housing having a front side and a rear side when viewed in a direction of a longitudinal center axis of said working tool;

a tool member connected to said front side of said motor housing and extending forwardly in a direction of said longitudinal center axis;

said tool member driven by said drive motor;

a rear grip connected by vibration damping elements to said rear side of said motor housing and extending rearwardly in the direction of said longitudinal center axis, said vibration damping elements positioned at a top side of said motor housing and providing an initial damping action between said rear grip and said motor housing;

an abutment device comprising a first abutment member connected to said motor housing and positioned between said rear end and said rear grip and comprising a second abutment member connected to said rear grip and cooperating with said first abutment member for limiting a relative movement between said motor housing and said rear grip;

wherein one of said first and second abutment members is a rigid abutment flange having a bore and wherein the other of said first and second abutment members is a bolt penetrating said bore, wherein said bolt, in a rest position of said housing and said rear grip, is radially spaced with play from an inner wall of said bore;

wherein under load conditions movement of said motor housing relative to said rear grip is limited and a precise and stiff guiding of said working tool is provided by said bolt moving radially to overcome said play and rest at said inner wall of said bore;

wherein said abutment flange is positioned in a plane extending parallel to a plane of said rear grip;

wherein said abutment device further comprises a fastening flange having a connecting portion, wherein said connecting portion is connected to said abutment flange, wherein said fastening flange, said connecting portion, and said abutment flange together form a Z-shaped base body, and wherein said fastening flange and said abutment flange extend parallel and spaced at a distance to one another;

wherein said connecting portion rests at said rear side of said housing; wherein said abutment flange is closer to said longitudinal center axis than said fastening flange;

wherein said motor housing comprises a fastening projection and wherein said fastening flange engages said fastening projection.

2. A working tool according to claim 1, wherein:

said rear grip comprises at least one securing flange;

said first abutment member extends perpendicularly to said rear side and adjacent to said at least one securing flange; and said second abutment member is connected to said at least one securing flange.

3. A working tool according to claim 1, wherein said motor housing comprises a basic casing and a cover, wherein said first abutment member engages said housing at a separating plane between said basic casing and said cover and is secured at said housing by a screw.

4. A working tool according to claim 1, wherein said abutment device comprises an elastic element positioned between said first and second abutment members.

5. A working tool according to claim 4, wherein said elastic element encloses one of said first and second abutment members.

6. A working tool according to claim 1, wherein said first and second abutment members intermesh with one another.

7. A working tool according to claim 1, wherein said abutment device and said vibration damping elements are positioned within a same half of said motor housing divided along said central longitudinal center axis.

8. A working tool according to claim 1, wherein said vibration damping elements and said abutment device are positioned in a plane parallel to a sidewall of said motor housing.

9. A working tool according to claim 1, wherein said abutment device is positioned on said longitudinal center axis.

10. A working tool according to claim 1, wherein said rear grip is comprised of:

an end plate extending parallel to said rear end of said motor housing, said end plate having an upper end and a lower end;

a bottom plate having a first end and a second end, wherein said first end is connected to said lower end of said end plate and wherein said end plate extends rearwardly from said end plate;

an actuating section connected to said upper end of said end plate and said second end of said bottom plate; and wherein said abutment device is positioned between said end plate and said rear end, wherein said bolt is fastened to said end plate and extends transverse to said longitudinal center axis.

* * * * *